US010562750B2

(12) United States Patent
Peirsman et al.

(10) Patent No.: US 10,562,750 B2
(45) Date of Patent: Feb. 18, 2020

(54) BEVERAGE DISPENSING DEVICE FOR DISPENSING DIFFERENT TYPES OF BEVERAGES OR BEVERAGE COMPONENTS

(71) Applicant: Anheuser-Busch InBev S.A., Brussels (BE)

(72) Inventors: Daniel Peirsman, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 15/108,316

(22) PCT Filed: Dec. 19, 2014

(86) PCT No.: PCT/EP2014/078721
§ 371 (c)(1),
(2) Date: Jun. 26, 2016

(87) PCT Pub. No.: WO2015/097085
PCT Pub. Date: Jul. 2, 2015

(65) Prior Publication Data

US 2016/0318747 A1 Nov. 3, 2016

(30) Foreign Application Priority Data

Dec. 27, 2013 (EP) ..... 13199702

(51) Int. Cl.
*B67D 1/00* (2006.01)
*B67D 1/08* (2006.01)
*B67D 1/14* (2006.01)

(52) U.S. Cl.
CPC ..... *B67D 1/0022* (2013.01); *B67D 1/0888* (2013.01); *B67D 1/1477* (2013.01); *B67D 2210/0006* (2013.01)

(58) Field of Classification Search
CPC ..... B67D 2210/0006; B67D 1/0022; B67D 1/1477; B67D 1/0888
USPC ..... 222/145.1, 145.7
See application file for complete search history.

(56) References Cited

U.S. PATENT DOCUMENTS 5,009,082 A * 4/1991 Abraham, III ..... B67D 1/0867 222/146.6
5,803,320 A * 9/1998 Cutting ..... B67D 1/0036 222/129.1
7,451,895 B2 * 11/2008 Newton ..... B01F 5/0496 222/105

(Continued)

FOREIGN PATENT DOCUMENTS

EP 1 669 322 6/2006
GB 2479483 10/2011

*Primary Examiner* — Donnell A Long
(74) *Attorney, Agent, or Firm* — Levy & Grandinetti

(57) ABSTRACT

A beverage dispensing device dispenses different types of beverages or beverage components. At least one type of beverage is a malt based beverage or beverage component. The dispensing device has multiple supply lines each extending from a corresponding supply source and having a controllable supply line valve as well as a controlling device for sequentially setting the controllable supply line valves. A beverage dispensing device contains multiple beverages or beverage components to be dispensed into a receptacle after every sequence step has been executed and during a single tapping cycle.

16 Claims, 9 Drawing Sheets

(56) References Cited

U.S. PATENT DOCUMENTS

| | | | | |
|---|---|---|---|---|
| 2005/0158798 | A1* | 7/2005 | Sher | C12C 12/00 435/7.1 |
| 2007/0204930 | A1 | 9/2007 | Phallen et al. | |
| 2007/0205220 | A1* | 9/2007 | Rudick | B67D 1/0025 222/129.4 |
| 2010/0304005 | A1* | 12/2010 | Beale | A47G 21/04 426/665 |
| 2011/0017776 | A1 | 1/2011 | Metropulos et al. | |
| 2012/0211575 | A1* | 8/2012 | Hemminger | B05B 1/265 239/589 |
| 2013/0056493 | A1* | 3/2013 | Newton | B67D 1/0016 222/129.3 |
| 2016/0107873 | A1* | 4/2016 | Callaghan | B67D 1/0035 222/94 |

* cited by examiner

BEVERAGE DISPENSING DEVICE FOR DISPENSING DIFFERENT TYPES OF BEVERAGES OR BEVERAGE COMPONENTS

The present invention relates to a beverage dispensing device for dispensing different types of beverages or beverage components.

More in particular, the present invention relates to such a beverage dispensing device, wherein at least one of said beverages or beverage components is a malt based beverage or a malt based beverage component.

Typically, a beverage dispensing device according to the invention is intended to be installed in a pub or bar or the like for directly serving customers sitting in the pub or at the bar.

According to the state of the art all kinds of beverage dispensing devices exist which allow for the dispensing of different types of beverages or beverage components, such as beverage dispensing devices for dispensing different types of coffees and teas possibly mixed with milk, cream or sugar and so on.

Usually, the coffee or tea is made by passing hot water through coffee powder or tea leaves respectively.

Other beverage dispensing devices are for example intended for dispensing all kinds of juices or sodas.

It is clear that such beverage dispensing devices are of a complete other category than the type of beverage dispensing devices of interest in the present invention.

Indeed, the dispensing of different types of beverages or beverage components wherein at least one of the one of said beverages or beverage components is a malt based beverage or a malt based beverage component requires adapted equipment which is capable of coping with the specific needs related to malt based beverages or beverage components.

For example when dispensing a malt based beverage or beverage component, it is important to control foaming of the concerned beverage or beverage component.

Also, in beverage dispensing device having supply lines through which malt based beverages or malt based beverages are passed, a biofilm is slowly formed into the supply lines.

This biofilm reduces the quality for as far as the taste and smell is concerned of the dispensed malt based beverages or beverage components through the supply lines and must therefore be very regularly removed by a thorough cleaning of the supply lines.

Furthermore, the rate of dispensing, the pressures involved during dispensing and the volumes of liquid dispensed in beverage dispensing devices wherein at least one of the beverages or beverage components is a malt based beverage or a malt based beverage component are usually much higher than in the typical coffee machines or the like and require adapted equipment with increased capacity and strength.

According to the state of the art also all kinds of beverage dispensing devices in the form of tap equipment exist comprising multiple dispensing taps for dispensing all kinds of beers or malt based beverages.

A first disadvantage of these known types of beverage dispensing devices in the form of tap equipment is that they require a lot of space, since many dispensing taps are installed near one another above a tap table, which tap table needs to have the required width for this purpose.

Usually, each single dispensing tap of such tap equipment receives beer from a single corresponding beer supply, such as a keg or barrel.

Another disadvantage of such beverage dispensing device is that a lot of supply lines are provided parallel to one another each supply line connecting a beer keg to a corresponding dispensing tap.

Moreover, these parallel supply lines extend often over a long distance, i.e. the distance between the place of storage of the beer barrels or kegs and the bar, and need to be cooled over said distance in order to avoid warming up of the beer.

At present there is a trend to fancier kinds of beverages, wherein multiple beverage components or beverages are added to one another so to provide a consumer with a sensation adapted to his taste.

Still another disadvantage of the known beverage dispensing devices is that often the dispensing of such a fancy type of beverage requires a lot of manipulations and a certain level of handiness of the persons dispensing the beverage.

A typical example is a drink which is called a black and tan and which is a drink made of a blend of a beer of a light colour such as pale ale and a darker beer such as a stout or Guinness or the like.

Hereby, the black and tan beverage forms a layered beer, the beer of lighter colour being essentially not mixed with the beer of darker colour, both beers forming a separate beverage layer.

In order to dispense such a kind of black and tan beverage, according to current practices, both beers are supplied through different dispensing taps and the top layer is poured slowly over an upside-down table spoon placed over the glass so to avoid splashing and mixing of the beers.

It is understood that dispensing of such a beverage requires some skill and is time consuming.

It is also clear that depending on the person that is dispensing the beverage the volume ratio of the different beverage components dispensed can vary easily, resulting in a varying composition of the finally dispensed beverage, which is often not desired.

It is therefore an objective of this invention to overcome one or more of the above-mentioned drawbacks or possibly other non-mentioned drawbacks of the known beverage dispensing devices.

To this aim, the present invention proposes a beverage dispensing device for dispensing different types of beverages or beverage components, at least one of which being a malt based beverage or beverage component, the beverage dispensing device comprising at least:

- multiple supply sources each containing a beverage or a liquid, a gaseous or a solid beverage component;
- an output line of the beverage dispensing device through which a beverage dispensed by the device is supplied to a receptacle;
- dispensing means for opening and closing the output line and comprising a dispensing valve which is operated by operating means for opening the dispensing valve in order to supply a beverage;
- multiple supply lines, each supply line extending from a corresponding supply source and comprising a controllable supply line valve which can be set in an open and closed position;
- connecting means connected at the one hand to every supply line and at the other hand to the output line; and,
- a controlling means for sequentially setting the controllable supply line valves, wherein in each sequence step the controllable supply line valves are set into a closed or open position according to a pre-determined setting, a beverage containing multiple beverages or beverage components being dispensed into the receptacle after every sequence step has been executed and this during a single tapping cycle.

Such a beverage dispensing device in accordance with the invention is very advantageous in that multiple beverages or beverage components can be dispensed through a single output line and dispensing tap and this even within a single tapping cycle.

In that way a beverage dispensing device is obtained by which a beverage such as a black and tan beer can be dispensed through the dispensing valve and the single output line and this in one fluent movement, without the need for closing the dispensing valve after the bottom layer of the black and tan beer has been dispensed.

A beverage dispensing device according to the invention is preferably provided with controlling means that function completely automatically.

Such a beverage dispensing device according to the invention can dispense a beverage comprising multiple beverages or beverage components in one single tapping cycle without the need of any intervention by a person, apart from the starting the tapping cycle.

With the intention of better showing the characteristics of the invention, hereafter, as example without any limitative character, some embodiments of a beverage dispensing device according to the invention are described, with reference to the accompanying drawings, wherein.

Figure 1:
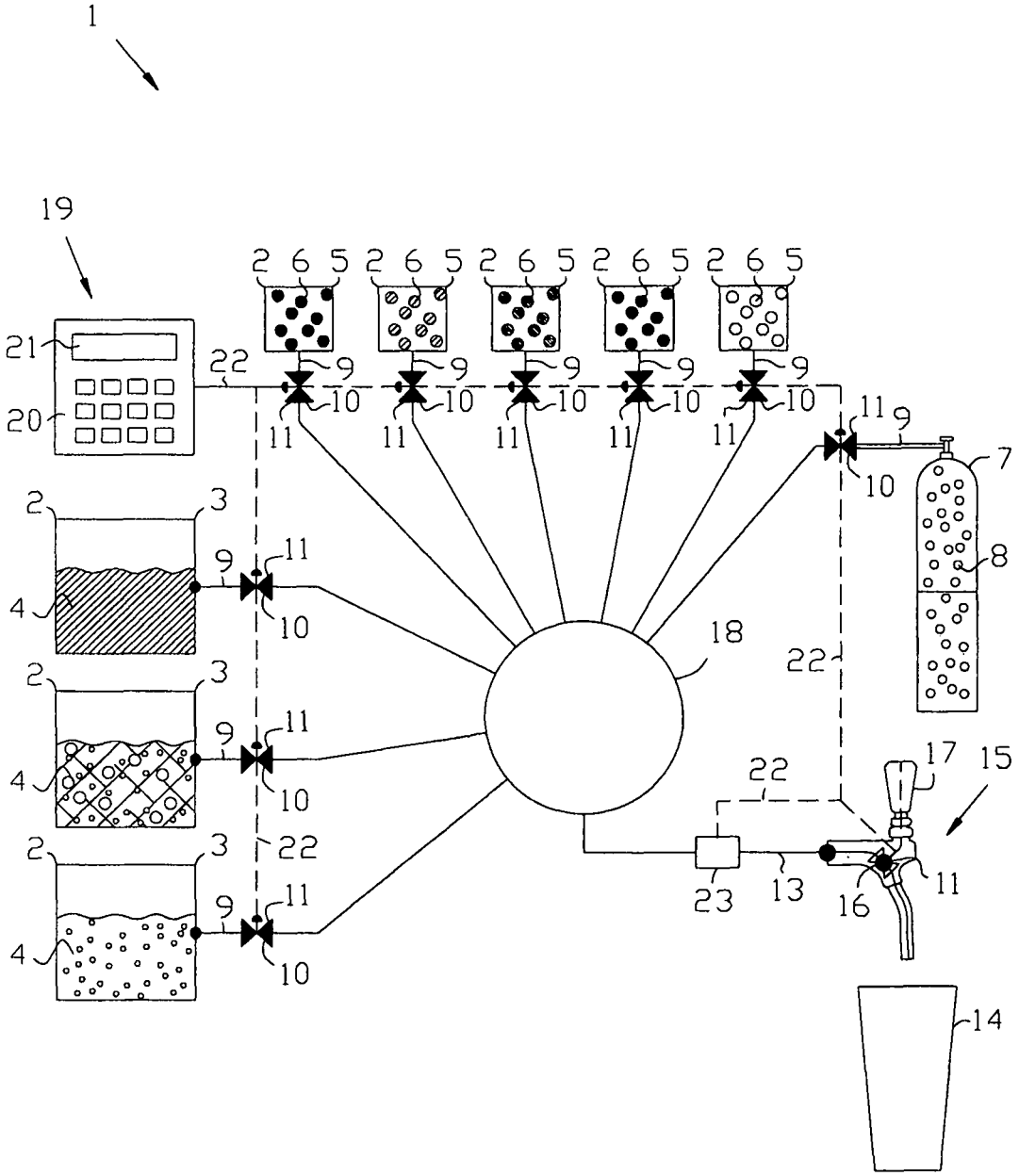
FIG. 1 is a schematic illustration of a first embodiment of a beverage dispensing device in accordance with the present invention.

The first embodiment of a beverage dispensing device 1 according to the invention, illustrated in FIGS. 1 to 5, is first of all provided with multiple supply sources 2.

In this first embodiment some of the supply sources 2 are barrels, bottles, containers or kegs 3 or the like which contain a liquid beverage or liquid beverage component 4.

Such a liquid beverage or beverage component 4 can for example be a juice, a soda, a strong alcohol, a coffee, a tea, a beer or a beer concentrate, a diluting liquid such as water, a carbonated liquid or a flat liquid and so on.

Furthermore, some of the supply sources 2 are containers or boxes 5 which contain solid beverage components 6, such as powders of aromatic ingredients, coffee powder, sugar, ground spices, any kind of flavour 6 and so on.

Finally, one of the supply sources 2 is a gas bottle 7 containing in this case gaseous and also liquefied carbon dioxide 8.

Supply lines 9 are extending from each supply source 2 and in each supply line 9 a controllable supply line valve 10 is provided in the represented case, which supply line valves 10 can be set in a closed position, indicated in the drawings by a valve symbol 11 which is fully coloured in black, and an open position, indicated in the drawings by a valve symbol 12 which is not coloured.

Another aspect of a beverage dispensing device 1 in accordance with the invention is that is provided with an output line 13, preferably a single output line 13, through which a beverage dispensed by the device 1 is supplied to a receptacle 14, usually a glass 14.

In order to open and close the output line 13 the beverage dispensing device 1 is provided with dispensing means 15, forming in this case a dispensing tap 15 which comprises a dispensing valve 16 by which the output line 13 is set open or is closed off.

In the illustrated case the dispensing valve 16 is a ball valve 16 which is operated by operating means 17 which are formed by a manually operated tap handle 17.

As an alternative, it is according to the invention not excluded to provide dispensing means 15 which comprise electrically or electronically controlled operating means 17 operated by means of for example a push-button, an electric switch, a key-board, a touch screen, or the like.

A beverage dispensing device 1 in accordance with the invention furthermore comprises connecting means 18 which are connected at the one hand to every supply line 9 and at the other hand to the output line 13.

In the drawings these connecting means 18 are symbolically represented by a circle 18.

In practice the connecting means 18 can form a kind of chamber 18, but it is possible as well that the connecting means 18 are just formed by an interconnection of the supply lines 9 and the output line 13 without forming a real interconnecting chamber, while still other alternatives are also not excluded from the invention.

The beverage dispensing device 1 according to the invention also comprises controlling means 19 for sequentially setting the controllable supply line valves 10.

In the figures the controlling means 19 are represented by a controller 19 which comprises an interface 20 in the form of a keyboard 20 for interaction with a user, as well as a display 21.

However, according to the invention it is not excluded that the controlling means 19 are completely invisible for a user and consists of only internal parts of the beverage dispensing device.

Preferably, the controlling means 19 are provided with a programmable memory, for example formed by a PLC or by a computer.

Nevertheless, as an alternative it is also possible to realize controlling means 19 which are based on purely mechanical methods, for example with techniques known from pneumatics or hydraulics.

Of course the application of a combination of electronic, electric and mechanic techniques is allowable as well.

Each supply line valve 10 is controlled by the controlling means 19, for example through electrical wiring or control cabling 22, which is schematically represented in the figures by dashed lines 22.

In the embodiment represented in FIGS. 1 to 5 the tap handle 17 is used for operating and setting the dispensing valve 16 into an open position or a closed position, respectively for starting and stopping the tapping cycle.

The status into which the dispensing valve 16 is set, is monitored by the controlling means 19 through wiring 22, which is also indicated by a dashed line 22, and this status of the dispensing valve is used as an input for the controlling means 19.

In an alternative embodiment, the controlling means could be realized such that the status of the dispensing valve 16 is set by the controlling means 19, for example after a user has given some instructions on the keyboard 20.

In such an embodiment the operating means 17 are part of the controlling means 19.

In a preferred embodiment of a beverage dispensing device 1 in accordance according to the invention, and as is also the case in the represented figures, the controlling means 19 comprise additionally flow rate controlling means 23 for controlling the flow rate through the output line 13.

This means for controlling the flow rate 23 through the output line 13 can for example comprise choking means by which the section of the output line 13 which is open for fluid flow can be reduced or increased so to set the desired flow rate, which is schematically represented in the figures by a rectangle in the output line 13.

In another embodiment however the flow rate controlling means can comprise pressurizing means, not illustrated in the figures, for setting a driving pressure by which a beverage or beverage component 4, 6 and/or 8 is driven out of its corresponding supply source 2.

The controlling means 19 sequentially set the controllable supply line valves 10 whereby in each sequence step the controllable supply line valves 10 are set into a closed or open position according to a pre-determined setting.

After the complete cycle of different sequence steps has been executed, a beverage 24 containing multiple beverages or beverage components 4, 6 and/or 8 is dispensed into the receptacle 14 and this during a single tapping cycle, i.e. the user only needs to open and close the dispense valve 15 by means of the tap handle 17.

This is illustrated in more detail in FIGS. 1 to 5.

In FIG. 1 a status of the beverage dispensing device 1 is represented, before the actual dispensing has started.

The tap handle 17 is in the upright position corresponding to a closed status of the dispensing valve 16.

This closed status of the dispensing valve 16 is detected by the controlling means 19 via wiring 22 and as a result, the controlling means 19 set all the controllable supply line valves 10 into the closed status.

Figure 2:
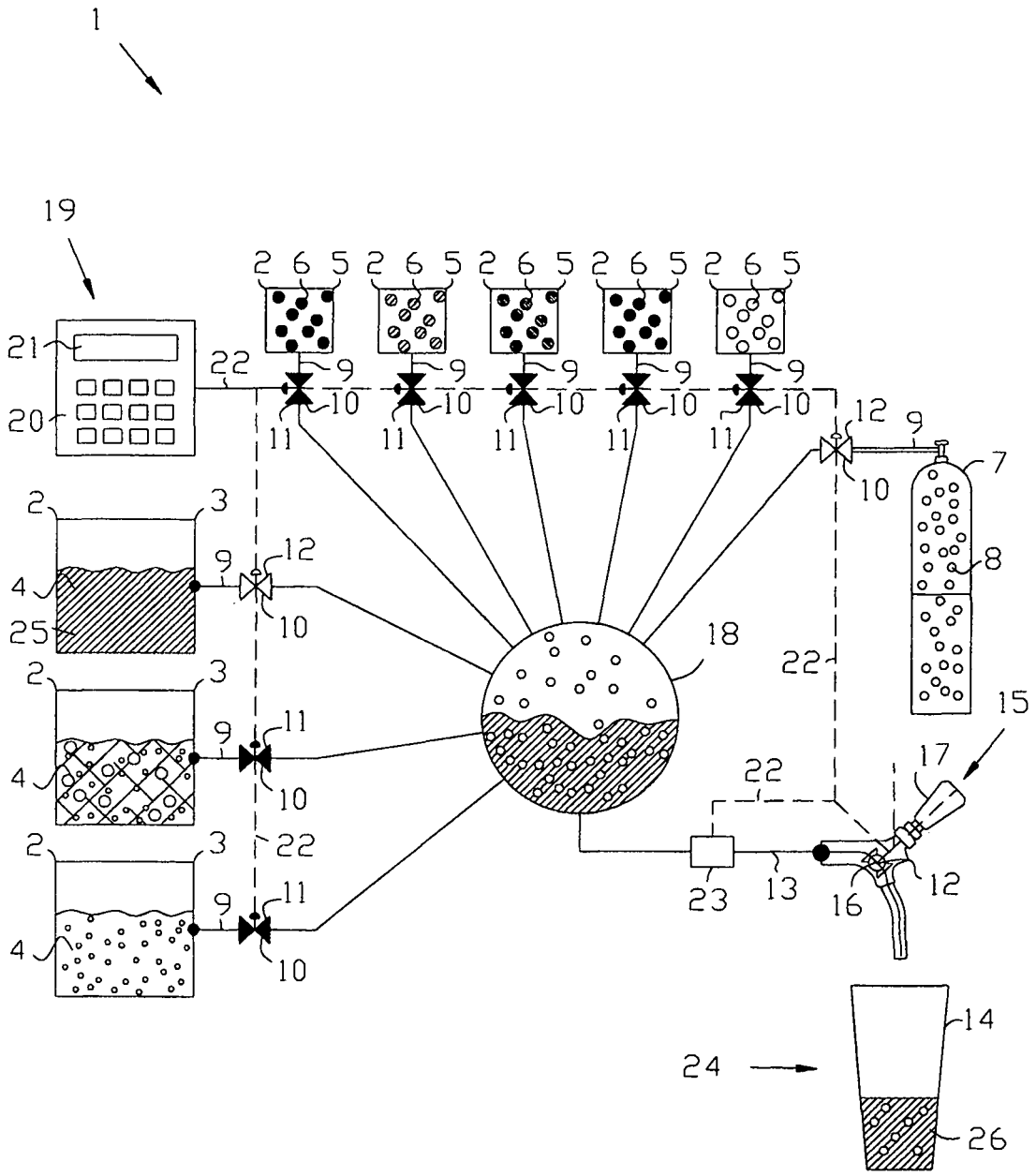
FIGS. 2 to 5 illustrate subsequent sequence steps during dispensing of a multi-layered beverage with the beverage dispensing device represented in FIG. 1.

When a user turns the tap handle 17 as illustrated in FIG. 2 into a position corresponding to the open status of the dispensing valve 16, the tapping cycle starts.

The open status of the dispensing valve 16 is detected by the controlling means 19 and this triggers the sequences programmed in the controlling means 19 for setting the supply line valves.

In this case, in a first sequence step, which is represented in FIG. 2, the controlling means 19 opens the supply line valve 10 of a first supply source 2 of a flat liquid beverage or beverage component 25 and the supply line valve 10 of the bottle 7 with carbon dioxide.

In that way the flat liquid beverage or beverage component 25 is mixed with carbon dioxide so to form a carbonated beverage component.

The flat liquid beverage 25 can for example be a flat beer or flat beer concentrate, as well as a juice or any other liquid beverage or beverage component.

The concerned supply line valves 10 are kept open by the controlling means 19 as long as is needed in order to provide a first beverage layer 26 of carbonated liquid in the receptacle 14.

Meanwhile, the flow rate through the output line 13 is also controlled by the controlling means 19 through the flow rate controlling means 23 so to fill the receptacle 14 in the most efficient way.

After the first beverage layer 26 has been dispensed, the controlling means 19 firstly closes automatically all supply line valves 10 and set the supply line valves 10 into another status according to a pre-determined setting corresponding to the second sequence step programmed in the controlling means 19.

Figure 3:
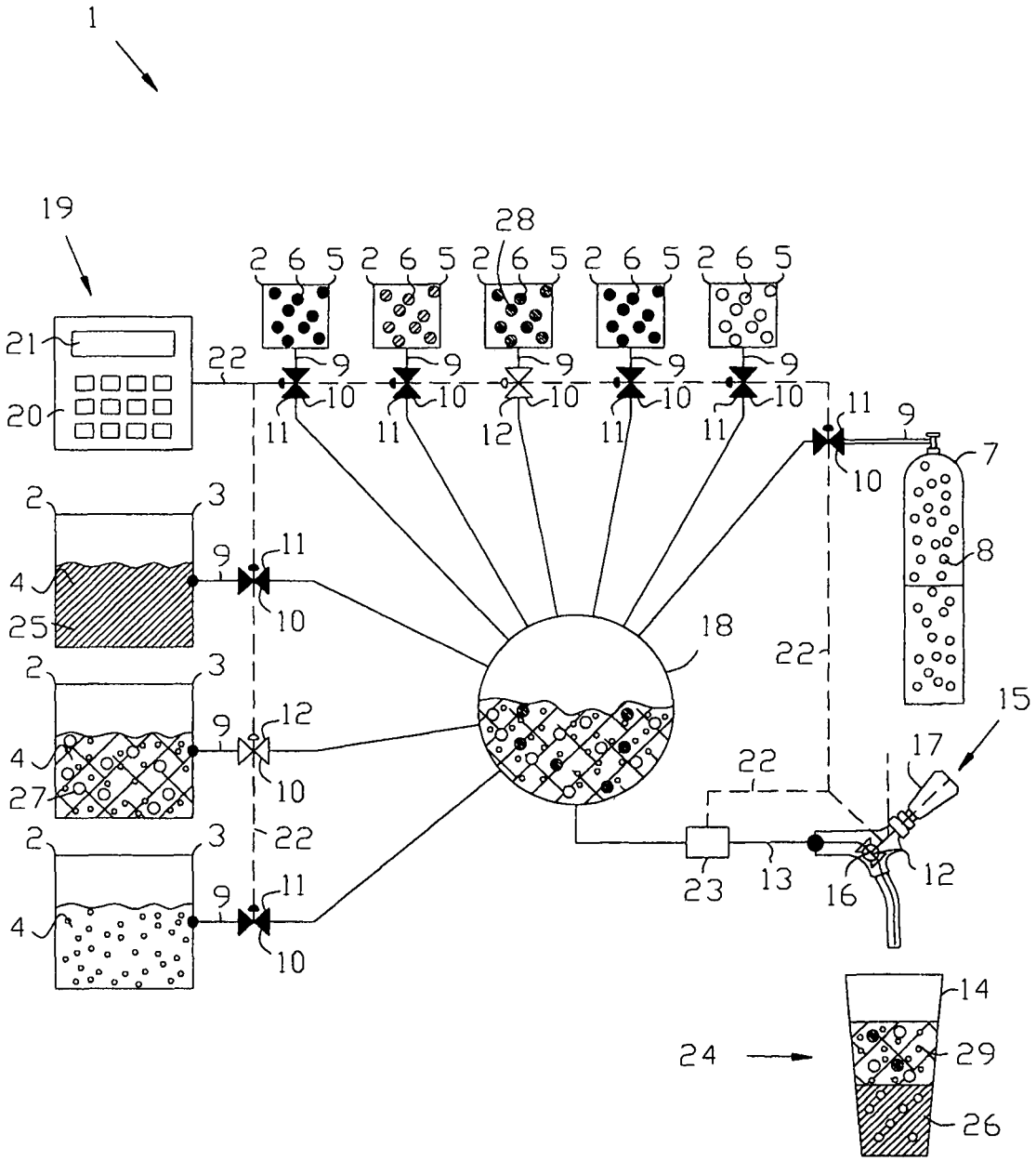

This second sequence step is represented in FIG. 3 and is such that this time the supply valve 10 of another carbonated liquid beverage 27 supply source 2 is opened as well as the supply line valve 10 of a supply source 2 containing a solid beverage component 28.

As a result, in this second sequence step a mixture of the carbonated liquid 27 and the solid beverage component 28 is supplied to the receptacle 14 so to dispense a second beverage layer 29 in the receptacle 14.

The controlling means 19 are in this case such that the flow rate of dispensing is kept under control so to prevent mixing of the different beverages or beverage components dispensed into the receptacle 14 during dispensing.

This can for example be obtained by sufficiently reducing the flow rate or even by providing guiding means, which are for example automatically unfolded by the controlling means 19, and which guide the liquid to be dispensed on top of the already dispensed former beverage layer 26.

After the second sequence step the controlling means 19 closes again all the supply line valves 10 after which it sets the supply line valves 10 as well as the flow rate controlling means 23 into a status corresponding to a pre-determined setting programmed in the controlling means corresponding to the final sequence step.

Figure 4:
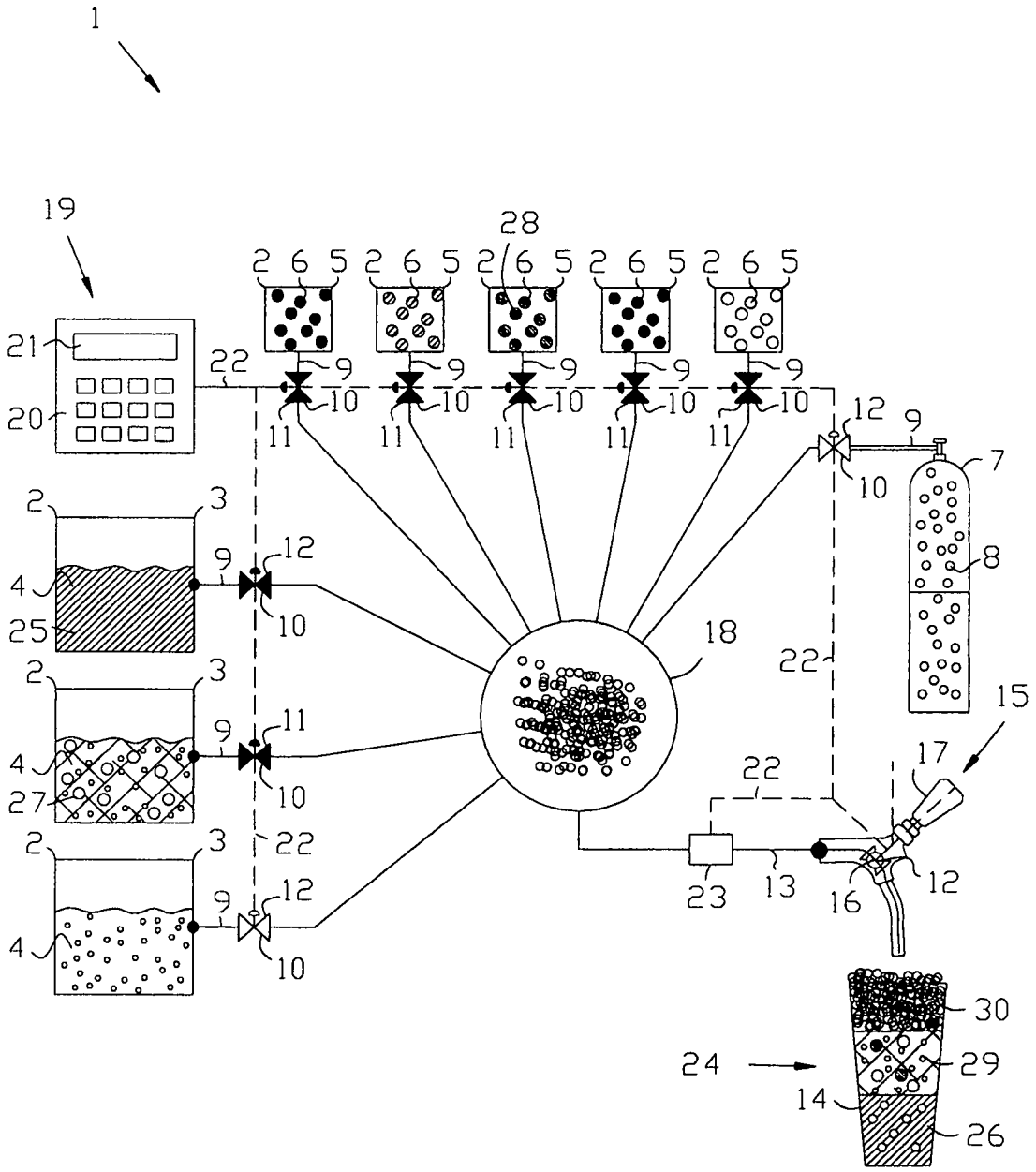
Figure 5:
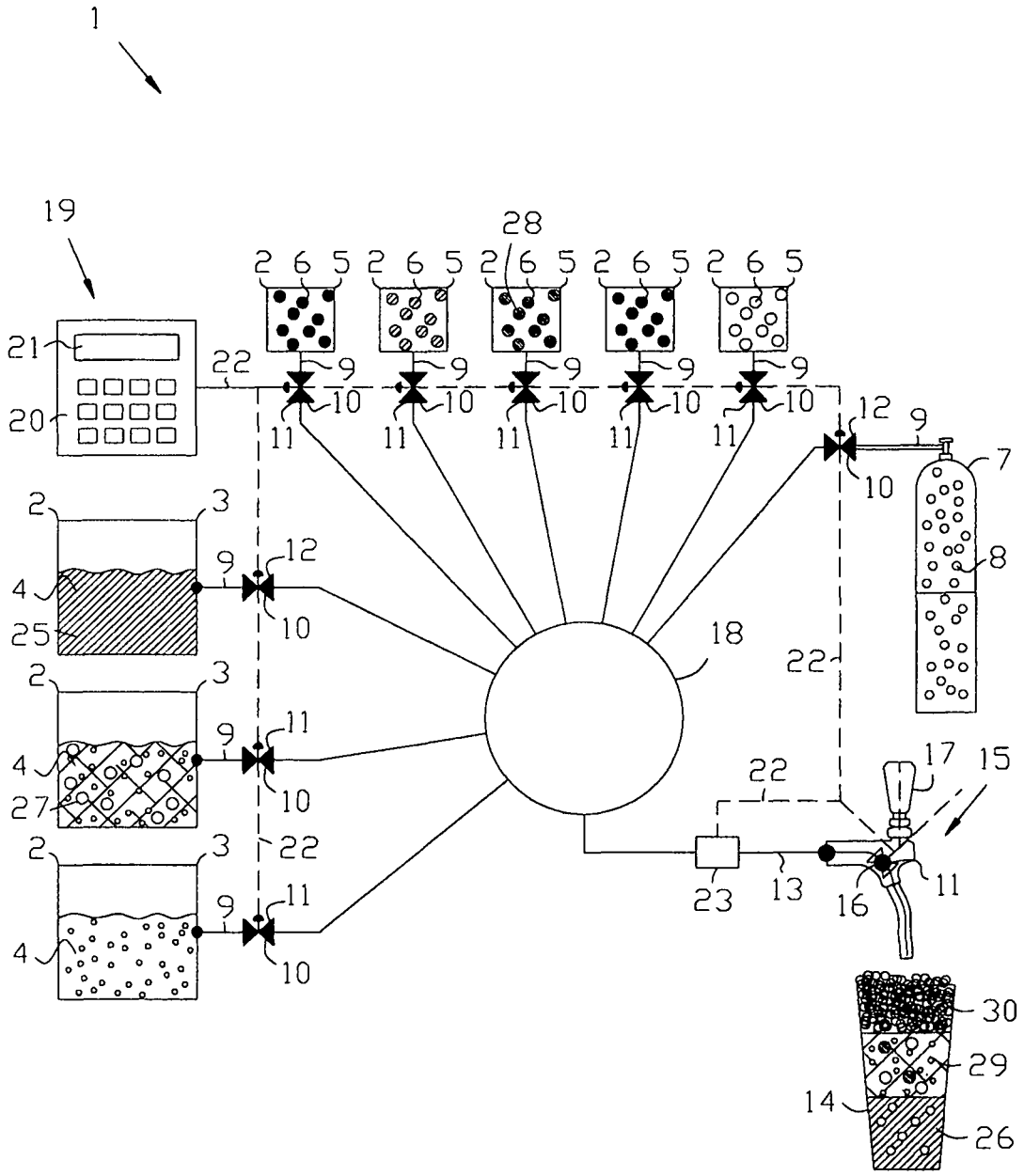

In this case in the final sequence step a foam layer 30 is provided on top of the beverage 24, which is illustrated in FIG. 4.

In order to produce a foam layer 30 of good quality, different parameters of the beverage dispensing device 1, such as the opening of the concerned valves 10, or the pressure in the supply lines 9 or the output line 13, should be set correctly by the controlling means 19.

It has to be understood that the former example is only intended for illustrating the possibilities and that a beverage dispensing device 1 in accordance with the invention can be intended for dispensing only one beverage component or on the contrary multiple beverage components at the same time for forming one of the beverage layers.

The final beverage 24 can comprise multiple beverage layers or can be not layered at all and similarly a foam collar can be provided or can be omitted.

After closing the tap handle 17 by the user the dispensing valve 16 is again in the closed status, which is detected by the controlling means 19 and which is the triggering event for finalising the tapping cycle by closing all the supply line valves 10.

It is obvious that in even the closing of the dispensing valve 16 could be controlled as well by the controlling means 19, for example in an embodiment wherein no tap handle 17 is provided.

According to the invention the interface 20 of the controlling means 19 is preferably such that it allows a user to set or select or even to program a sequence of the controlling means 19.

FIGS. 6 to 9 represent still another embodiment of a beverage dispensing device 1 in accordance with the invention.

In this second embodiment each supply line 9 comprises the same supply line valve 31 which supply line valve 31 is forming part of the connecting means 18.

The supply line valve has a rotating part 32 with a narrow channel 33 intended to be brought into a position such that a selected supply line 9 is aligned with the channel 33, in the case this selected supply line 9 is supposed to be brought into an open status for supplying a beverage component.

The narrow channel 33 merges into a widening opening 34 of the rotating part 32, which opening 34 is intended to bring a supply line 9 aligned with the channel 33 into connection with the output line 13.

By turning the rotating part 32 at can also be brought into a position wherein all the supply lines 9 as well as the output line 13 are closed off.

Figure 6:
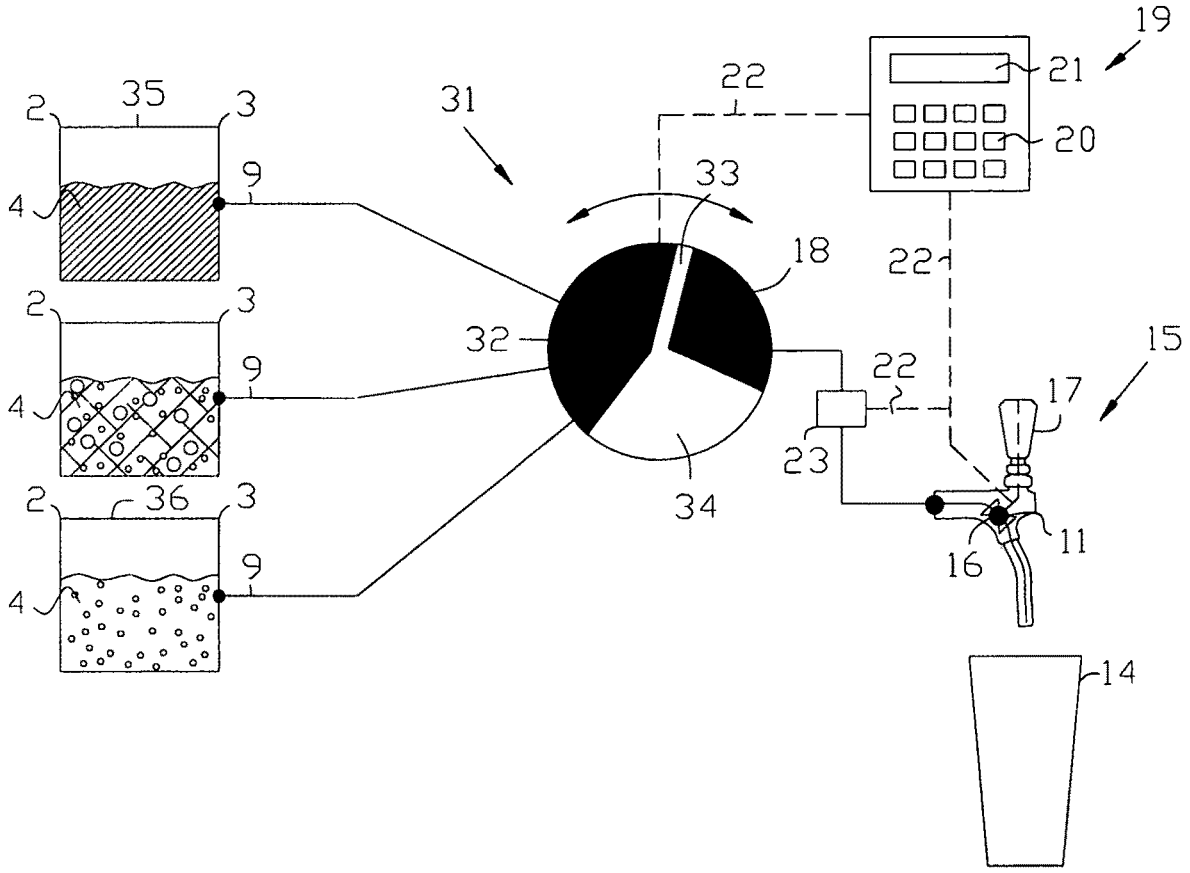
FIG. 6 is a schematic illustration of a second embodiment of a beverage dispensing device in accordance with the invention.

This is for example illustrated in FIG. 6.

In this embodiment of a beverage dispensing device 1 in accordance with the invention the controlling means 19 control the rotational position of the rotating part 32 of the supply line valve 31.

The principle is furthermore quite similar as in the preceding embodiment.

Figure 8:
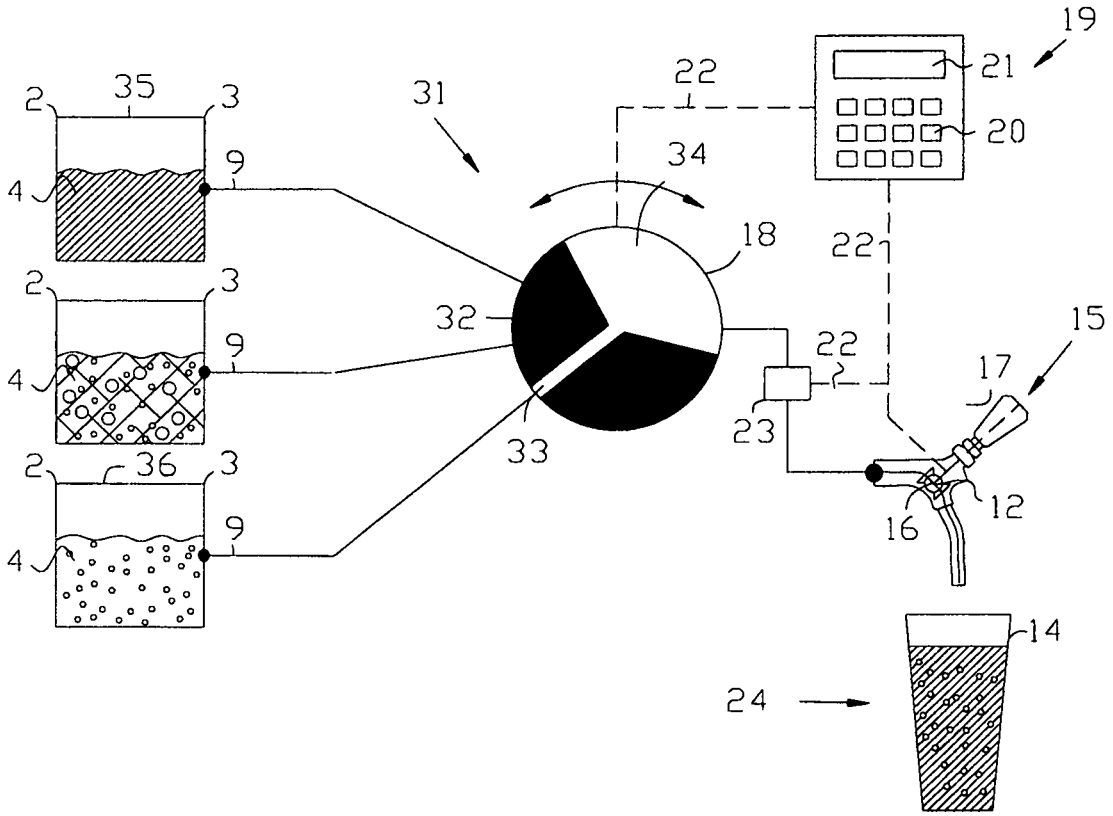
Figures 8, 9:
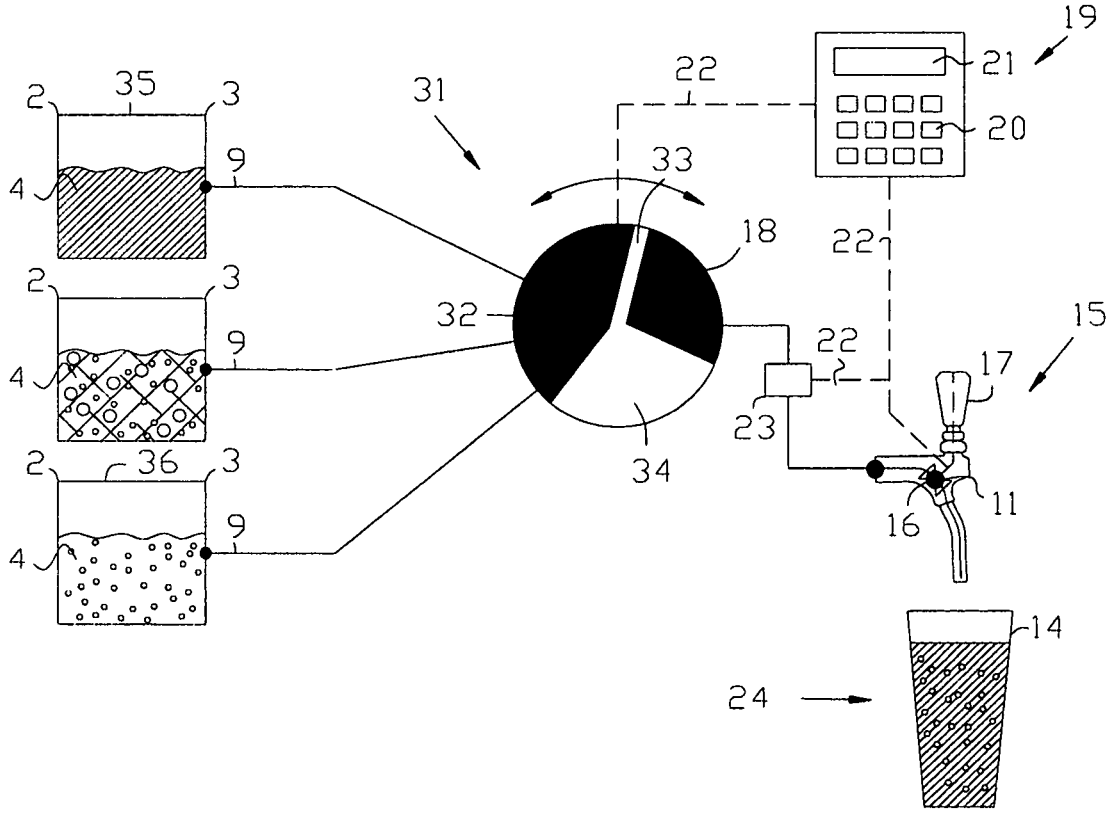

FIGS. 6 and 9 correspond to the situation wherein the tap handle 17 is brought into the upright position by a user, respectively before dispensing a beverage 24 and when the tapping cycle is finalised.

The controlling means 19 detects this status of the tap handle 17 or the corresponding status of the dispensing valve 16 and sets the rotating part 32 of the supply line valve 16 into a rotational position wherein all supply lines 9 as well as the output line 13 are closed off.

Figure 7:
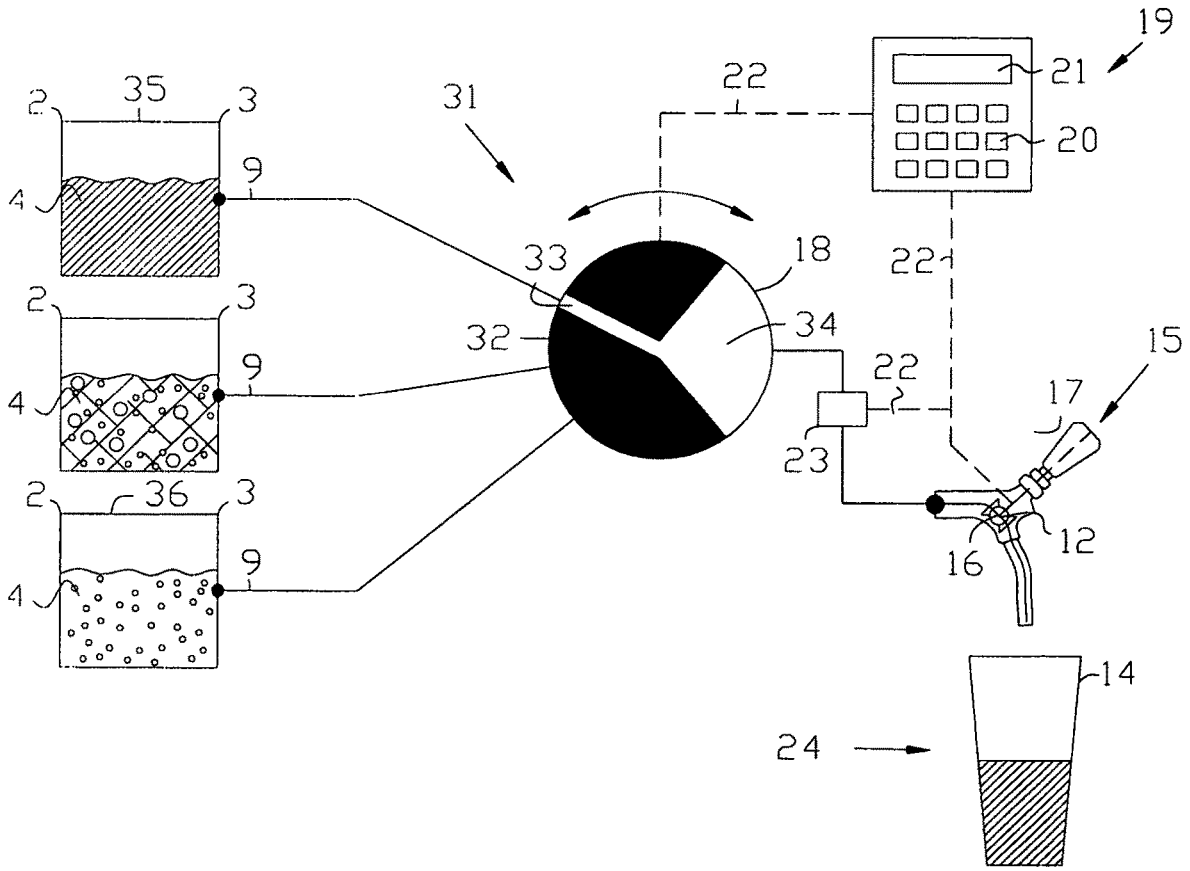
FIGS. 7 to 9 illustrate subsequent sequence steps during dispensing of a beverage with the beverage dispensing device represented in FIG. 6, the beverage being composed of a mixture of different beverages or beverage components.

By turning the tap handle 17 a user triggers the starting of the tapping cycle, which is illustrated in FIG. 7.

In a first sequence step the supply line valve 31 is set such that the supply line 9 of a first supply source 35 is aligned with the narrow channel 33 and the widening opening 34 with the output line 13 so to dispense liquid beverage or liquid beverage component 4 supplied from the first supply source 35 into the receptacle 14.

After a while the controlling means 19 finalise the first sequence step and set the supply line valve 31 into a pre-determined status as programmed in the controlling means so to initiate the second sequence step.

This second sequence step is illustrated in FIG. 8, the rotating part 32 of the supply line valve 31 being brought into a position wherein the supply line 9 of a second supply source 36 is aligned with the narrow channel 33 and the widening opening 34 with the output line 13 so to dispense liquid beverage or liquid beverage component 4 supplied from the second supply source 36 into the receptacle 14.

In this case the controlling means 10 set the flow rate by means of the flow rate controlling means 23 in such a way that the flow rate of dispensing is high enough to mix the different beverages or beverage components 4 in the receptacle 14 during dispensing, so to obtain a completely mixed beverage 24 and not a layered beverage as was the case in the preceding example.

It is clear that a beverage dispensing device 1 in accordance with the present invention simplifies a lot the work of barkeepers, certainly when a beverage must be dispensed comprising multiple beverages or beverage components, no or almost no intervention of the barkeeper being required.

Furthermore, a beverage dispensing device 1 in accordance with the invention can be very compact and it ensures a constant quality of the dispensed beverages.

The present invention is by no means limited to a beverage dispensing device 1 according to the invention, described as examples and illustrated in the drawings, but such a beverage dispensing device 1 according to the invention can be realised in all kinds of variants, without departing from the scope of the invention.

The invention claimed is:

1. A beverage dispensing device for dispensing different types of beverages or beverage components, at least one of which being a malt based beverage or beverage component, wherein the dispensing device comprises at least:

multiple supply sources each containing a beverage or a liquid, a gaseous, or a solid beverage component;

one of the multiple supply sources contains gaseous and liquefied carbon dioxide;

an output line of the beverage dispensing device through which a beverage dispensed by the device is supplied to a receptacle, the output line comprising a flow rate controlling device allowing altering the flow rate through the output line;

a dispensing device for opening and closing the output line and comprising a dispensing valve which is operated by an operating device for opening the dispensing valve in order to supply a beverage;

multiple supply lines, each supply line extending from a corresponding supply source and comprising a controllable supply line valve which can be set in an open and closed position;

a connecting device formed as a chamber connected at the one hand to every supply line and at the other hand to the output line prior to the output line flow rate controlling device; and a controlling device configured to sequentially set the controllable supply line valves and the flow rate controlling device, wherein in each sequence step, the controllable supply line valves and the flow rate controlling device are set into a closed or open position according to a pre-determined setting, a beverage containing multiple beverages or beverage components being dispensed into the receptacle after every sequence step has been executed and this during a single tapping cycle.

2. The beverage dispensing device according to claim 1, having only a single output line.

3. The beverage dispensing device according to claim 2, wherein the dispensing device forms a dispensing tap wherein the operating device is formed by a tap handle which is manually operated.

4. The beverage dispensing device according to claim 2, wherein the dispensing device comprises electrically or electronically controlled operating device operated by one or more of the following: a push-button; a switch; a key-board; a touch screen.

5. The beverage dispensing device according to claim 1, wherein the dispensing device forms a dispensing tap wherein the operating device is formed by a tap handle which is manually operated.

6. The beverage dispensing device according to claim 1, wherein the dispensing device comprises electrically or electronically controlled operating device operated by one or more of the following: a push-button; a switch; a key-board; a touch screen.

7. The beverage dispensing device according to claim 1, the device for controlling the flow rate through the output line further comprises a choking device.

8. The beverage dispensing device according to claim 1, wherein the device for controlling the flow rate through the output line further comprises a pressurizing device for setting a driving pressure by which a beverage or beverage component is driven out of its corresponding supply source.

9. The beverage dispensing device according to claim 1, wherein the controlling device further comprises a sequence with one or more sequence steps for dispensing a beverage or beverage components followed by a sequence wherein foam is dispensed on top of an already dispensed beverage or dispensed beverage components.

10. The beverage dispensing device according to claim 1, wherein one of the multiple supply sources contains a beverage or a liquid, a gaseous or a solid beverage component, which is one of the following: a malt based beverage; a beer; a beer concentrate; a carbonated liquid; carbon dioxide; nitrogen; an alcohol; a juice; a soft drink; a tea; a coffee; a chocolate.

11. The beverage dispensing device according to claim 1, wherein the controlling device functions completely automatically.

12. The beverage dispensing device according to claim 1, the device comprises an interface for interaction with a user.

13. The beverage dispensing device according to claim 12, wherein the interface allows to set or select a sequence of the controlling device.

14. A method of using the beverage device of claim 1, comprising:

dispensing a non-layered beverage;

by controlling means, setting the flow rate of dispensing of a subsequent sequence of the tapping cycle to a level allowing mixing the different beverages or beverage components dispensed during the subsequent tapping cycle with beverages or beverage components dispensed into the receptacle during one or more previous sequences of the tapping cycle.

15. A method of using the beverage dispensing device of claim 1, comprising:

dispensing a layered beverage;

by the controlling means, setting the flow rate of dispensing of a subsequent sequence of the tapping cycle to a level preventing mixing the different beverages or beverage components dispensed during a subsequent tapping cycle with beverages or beverage components dispensed into the receptacle during one or more previous sequences of the same tapping cycle, or by providing guide means, guiding the beverage or beverage components dispensed during the subsequent sequence on top of the beverages or beverage components dispensed into the receptacle during one or more previous sequences of the tapping cycle.

16. A method according to claim 15 of using the beverage dispensing device comprising an interface for interaction with a user for dispensing a black and tan beer, i.e., layered beverage (24) which is a blend of a light and a dark beer.

* * * * *